United States Patent [19]

Asano et al.

[11] Patent Number: 4,618,277

[45] Date of Patent: Oct. 21, 1986

[54] PRINT HEAD

[75] Inventors: Kiyomitsu Asano, Tokyo; Toshikatsu Kondo, Nagoya, both of Japan

[73] Assignees: Brother Kogyo Kabushiki Kaisha, Nagoya; Nippon Telecommunication Engineering Company, Tokyo, both of Japan

[21] Appl. No.: 789,342

[22] Filed: Oct. 17, 1985

Related U.S. Application Data

[63] Continuation of Ser. No. 548,355, Nov. 3, 1983, abandoned.

[30] Foreign Application Priority Data

Nov. 18, 1982 [JP] Japan ..... 57-175142[U]

[51] Int. Cl.[4] ..... B41J 3/12

[52] U.S. Cl. ..... 400/124; 101/93.05; 335/274

[58] Field of Search ..... 400/123, 124, 157; 101/93.05; 335/274, 276

[56] References Cited

U.S. PATENT DOCUMENTS

| | | | |
|---|---|---|---|
| 1,922,710 | 8/1933 | Owens | 101/123 |
| 3,756,152 | 9/1973 | Abler | 101/157 X |
| 4,206,266 | 6/1980 | Bellinger | 400/124 X |
| 4,307,966 | 12/1981 | Spencer et al. | 400/124 |

FOREIGN PATENT DOCUMENTS

| | | | |
|---|---|---|---|
| 2634184 | 2/1978 | Fed. Rep. of Germany | 400/124 |
| 57-971 | 4/1983 | Japan | 400/124 |

*Primary Examiner*—Paul T. Sewell
*Attorney, Agent, or Firm*—Moonray Kojima

[57] ABSTRACT

The print head has armatures each provided with a holding part connected to one end of a spring plate. For avoiding concentration of a tensile stress on a brazed part between the holding part and the spring plate, part of the holding part extending contiguously to one side of the spring plate, subjected to a compressive stress when the spring is bent, is longer than the part of the holding part extending contiguously to the other side of the spring plate subjected to a tensile stress when the spring plate is bent.

3 Claims, 5 Drawing Figures

PRINT HEAD

This application is a continuation of U.S. Application Ser. No. 548,355, filed Nov. 3, 1983, abandoned.

BACKGROUND OF THE INVENTION

1. Field of the Invention

This invention relates to a print head mounted on a dot matrix printer of the impact type, and more particularly to improvements in such print heads.

2. Discussion of the Prior Art.

A conventional print head of the above mentioned type is depicted, for example, in FIG. 1. The depicted print head may be classified as a release type head comprising a free end 2*a* of a spring 2 secured at the root thereof between a frame 1*a* and a yoke 1*b* which is fixed to one end of an armature 4 which is fixed at the other end thereof to a print wire 3. That is, free end 2*a* of spring plate 2 is fixed to a holding part 5 formed in one end of the armature usually by brazing. Armature 4 is attracted to core 8*a* of an electromagnetic device 8, by a permanent magnet 7, against the resilience of spring plate 2 and is released from attraction of permanent magnet 7, by exciting electromagnetic device 8. In this manner, the resilience of spring plate 2 drives print wire 3 selectively for printing action.

When electromagnetic device 8 is not excited, and hence spring plate 2 is bent against the resilience thereof toward core 8*a*, a compressive stress and a tensile stress are concentrated on the brazed part 6*a* on the side of core 8*a* and on the opposite brazed part 6*b*, respectively. Consequently, brazed part 6*b* is likely to be fissured by the concentrated tensile stress during repeated printing operation, thereby resulting in faulty connection of spring plate 2 and armature 4. Thus, reliability is adversely affected, and the life of the print head is considerably reduced. Since the surface of free end 2*a* joined toholding part 5 by brazing is alloyed with a brazing solder and brittle, free end 2*a*, in particular, is likely to be broken by the tensile stress, which acts directly on the brittle surface of the brazed surface of free end 2*a* when brazed part 6*b* is cracked.

Thus, an urgent need exists in the art for a print head which has a greater lifetime, and increased reliability.

SUMMARY OF THE INVENTION

Accordingly, an object of the invention is to overcome the aforementioned and other deficiencies and disadvantages of the prior art.

Another object is to provide a durable, reliable print head having a simple construction and capable of eliminating concentration of tensile stress on the junction of the spring plate and armature.

The foregoing and other objects are attained by this invention which encompasses an improved print head comprising a plurality of armatures each connected at one end thereof to a print wire; an electromagnetic device disposed correlatively with each armature to drive the armature selectively for printing operation; a U-shaped holding part formed in the other end of the armature; and a spring plate fixed at one end thereof to the holding part and fixedly held at the other end thereof. In this print head, one arm of the U-shaped holding part, which is subjected to a compressive stress when the spring plate is bent toward the core of the electromagnetic device, is longer than the other arm of the holding part subjected to tensile stress when the spring plate is bent for printing operation. By this novel construction involving the different dimensions of the holding part, stress is no longer concentrated at the junction of the spring and armature holding part.

DETAILED DESCRIPTION OF PREFERRED EMBODIMENTS

Figure 2:
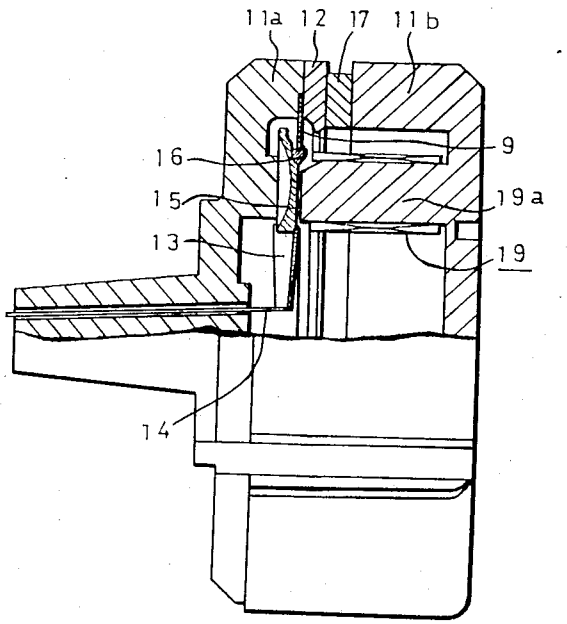
FIG. 2 is a sectional view depicting an illustrative embodiment of the invention.
Figure 1:
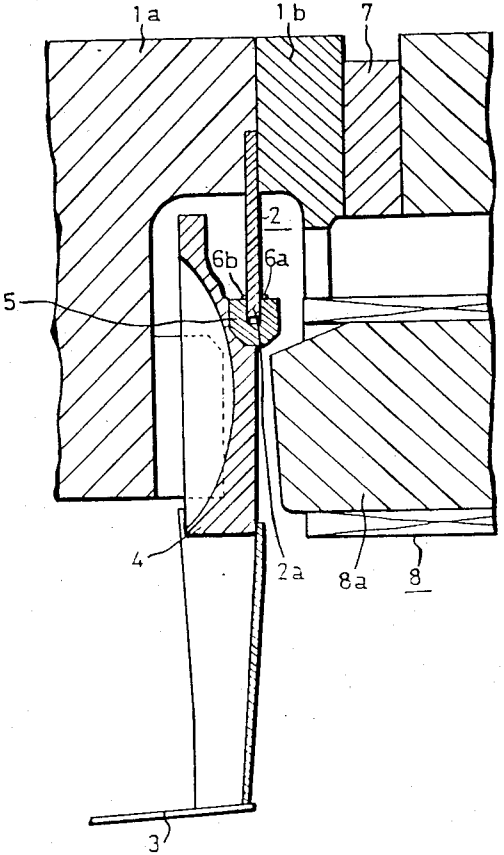
FIG. 1 (PRIOR ART)
FIG. 1 is a sectional view of part of a conventional print head.
Figure 3:
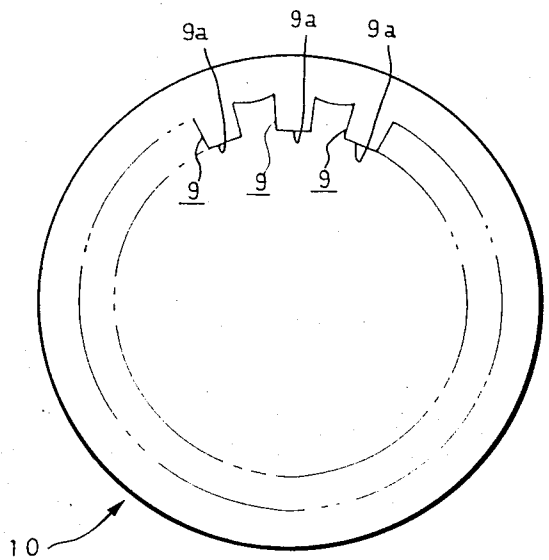
FIG. 3 is a plan view depicting a spring plate.

Referring first to FIG. 3, a plurality of spring plates 9 are formed in a circular spring plate 10. The roots of spring plates 9 are connected continuously and the free ends 9*a* of spring plates 9 extend centripetally. The roots of spring plates 9 are held fixedly between a front frame 11*a* and a yoke 12 (see FIG. 2)

Turning now to FIG. 2, a print wire 14 extends through a guide hole (not numbered) formed in front frame 11*a* and a free end of a wire arm 13, forming a part of an armature, are connected, for example, by brazing.

The other end of wire arm 13 and a front end of armature 15 are connected, for example, by brazing or laser spot welding. The rear end of armature 15 is provided fixedly with a holding part 16 for holding free end 9*a* (see FIG. 3) of spring plate 9. Armature 15 forms a part of a magnetic path for magnetic flux generated by an electromagnetic device 19. When electromagnetic device 19 is not excited, armature 15 is kept in contact with core 19*a* of electromagnetic device 19, against the resilient force of spring plate 9, by the magnetic force of a permanent magnet 17 supported fixedly between rear frame 11*b* and yoke 12.

Figure 4:
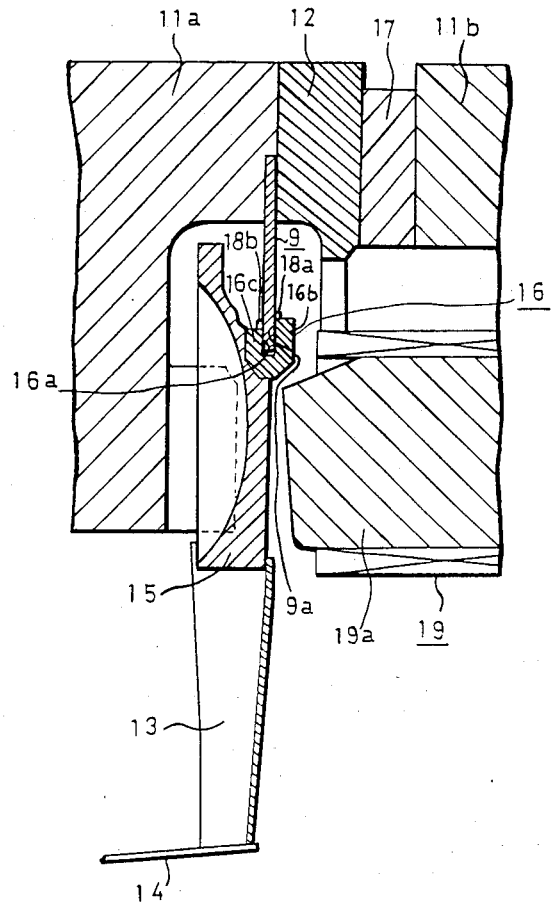
FIG. 4 is an enlarged partial sectional view depicting the print head when the electromagnetic device is excited.

Turning now to FIG. 4, holding part 16 has a practically U-shaped cross section and is provided centrally with a recess 16*a* for receiving free end 9*a* of spring plate 9. Right hand wall 16*b* of U-shaped part is higher than the left hand wall 16*c* of the U-shaped part. That is to say, part 16*b* is longer than 16*c*, as depicted. Spring plate 9 is connected to armature 15 by fitting free end 9*a* in recess 16*a* and brazing spring plate 9 and holding part 16 at brazed parts 18*a* and 18*b*. The spring plate is preferably made of age hardened stainless steel. The brazing alloy is preferably made of silver solder.

A plurality of electromagnetic devices 19 are supported on rear frame 11*b* at positions corresponding to the armatures, respectively. When excited, electromagnetic device 19 cancels the magnetic force of permanent magnet 17, thereby to release armature 15 from core 19*a*. This allows the resilience of spring plate 9 to move the corresponding print wire 14 selectively for printing a character in a dot matrix.

The operation of the illustrative embodiment will now be described in more detail in connection with FIG. 5.

Figure 5:
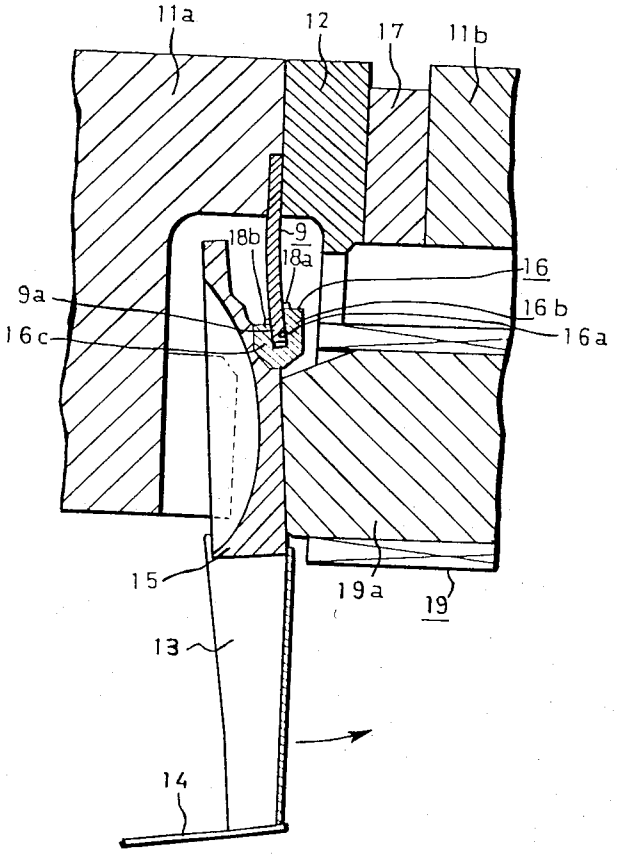
FIG. 5 is an enlarged partial sectional view depicting the print head when the electromagnetic device is not excited.

When electromagnetic device 19 is not excited, armature 15 is attracted by the magnetic force of permanent magnet 17 and is brought into contact with core 19*a* of electromagnetic device 19 (as shown in FIG. 5) so that spring plate 9 is bent against the resilient force thereof, about a fixed point defined by the end of right wall 16*b*. As spring plate 9 is thus bent, a compressive stress acts on brazed part 18*a* and a tensile stress acts on the part of spring plate 9 oppositely positioned corresponding to brazed part 18*a*, respectively. However, since brazed part 18*b* is displaced centripetally with respect to brazed part 18*a* by a predetermined distance in a centripetal direction, a tensile stress, distributed according to the predetermined distance, acts on brazed part 18*b*. That is to say, the difference between length of wall 16*b* and the length of wall 16*c* avoids or prevents concentration of tensile stress on brazed part 18*b*.

In this embodiment, the concentration of tensile stress on the brazed part 18*b* is thus avoided. Hence brazed part 18*b* is prevented from becoming fissured by tensile stress.

The foregoing description is illustrative of the principles of the invention. Numerous modifications and extrusions thereof would be apparent to the worker skilled in the art. All such modifications and extensions are to be construed to be within the spirit and scope of the invention.

What is claimed is:

1. A print head arrangement mounted on a dot matrix printer of an impact type, comprising a plurality of armatures (15), each connected fixedly at one end thereof to a print wire (14), said print wire (14) and said armature (15) being movable during printing operation; and electromagnetic device (19) disposed at a position corresponding to each of said armature (15) to drive a corresponding armature (15) and print wire (14) connected thereto selectively for printing operation; a holding part (16) connected to the other end of each said armature (15); and rigid resilient spring plate (9) fixed at one end thereof (9*a*) to said holding part (16) and held fixedly in a frame (11*a*) another end thereof; wherein said holding part (16) comprises a single unitary structure comprising a body portion connected to said other end of said armature, one arm portion (16*b*), another arm portion (16*c*), said body portion connecting said one arm portion and said other arm portion, and a recess (16*a*) formed by said one arm portion (16*b*), said other arm portion (16*c*) and said body portion for holding said one end (9*a*) of said spring plate therein, wherein said one arm portion (16*b*) extends from said body portion away from said armature and perpendicularly toward said frame (11*a*) in an unbent state and contiguously on one side of said spring plate, said one side of said spring plate being subjected to a compressive stress when said spring is bent in a predetermined direction during print operation, and is longer than said other arm portion (16*c*), and wherein said other arm portion (16*c*) extends from said body portion away from said armature and perpendicularly towards said frame (11*a*) in an unbent state and contiguously on another side of said spring plate, said other side of said spring plate is being subjected to a tensile stress when said spring plate is bent in said predetermined direction (arrow) during point operation, said spring plate (9) and said one arm portion (16*b*) and said other arm portion (16*c*) being joined together by brazing (18*a*, 18*b*) at ends opposite said body portion, whereby concentration of tensile stress is prevented at the brazed parts when said spring is bent in said predetermined direction (arrow).

2. The print head of claim 1, wherein said spring plate is inserted in said recess formed in said holding part, both sides of said spring plate and said holding part being joined respectively by brazing, to connect said spring plate to said armature.

3. The print head of claim 2, wherein said spring plate is made of an age hardened stainless steel and said brazing is with a brazing alloy of silver solder.

* * * * *